US009924800B2

(12) United States Patent
Slusher, II

(10) Patent No.: US 9,924,800 B2
(45) Date of Patent: Mar. 27, 2018

(54) SEAT SUPPORT ASSEMBLY FOR FURNITURE HAVING LEG REST EXTENSION AND SEAT BACK RECLINE

(71) Applicant: England, Inc., Monroe, MI (US)

(72) Inventor: Monroe B. Slusher, II, New Tazewell, TN (US)

(73) Assignee: England, Inc., Monroe, MI (US)

( * ) Notice: Subject to any disclaimer, the term of this patent is extended or adjusted under 35 U.S.C. 154(b) by 115 days.

(21) Appl. No.: 14/869,071

(22) Filed: Sep. 29, 2015

(65) Prior Publication Data

US 2017/0086591 A1 Mar. 30, 2017

(51) Int. Cl.

| | |
|---|---|
| ***A47C 7/35*** | (2006.01) |
| ***A47C 7/02*** | (2006.01) |
| ***A47C 7/22*** | (2006.01) |
| ***A47C 7/30*** | (2006.01) |
| ***A47C 7/34*** | (2006.01) |

(52) U.S. Cl.

CPC ..... *A47C 7/35* (2013.01); *A47C 7/021* (2013.01); *A47C 7/22* (2013.01); *A47C 7/30* (2013.01); *A47C 7/347* (2013.01)

(58) Field of Classification Search

CPC .. A47C 7/35; A47C 7/347; A47C 7/30; A47C 7/021; A47C 7/22

USPC ..... 297/452.52, 452.5, 452.49, 452.51, 297/452.53

See application file for complete search history.

(56) References Cited

U.S. PATENT DOCUMENTS

| | | | | | |
|---|---|---|---|---|---|
| 630,967 | A | * | 8/1899 | Bonnell | A47C 23/05 267/91 |
| 650,806 | A | * | 5/1900 | Bailey | A47C 7/347 297/452.5 |
| 793,172 | A | * | 6/1905 | Bigelow | A47C 23/05 5/209 |
| 2,109,282 | A | * | 2/1938 | Bernstein | A47C 7/35 267/99 |
| 2,186,548 | A | * | 1/1940 | Lotz | B60N 2/7058 267/87 |
| 2,234,253 | A | * | 3/1941 | Hopkes | A47C 7/35 267/102 |
| 2,280,912 | A | * | 4/1942 | Hopkes | A47C 23/30 267/87 |
| 2,305,530 | A | * | 12/1942 | Hopkes | A47C 7/35 222/248 |
| 2,313,130 | A | * | 3/1943 | Dorton | A47C 7/347 297/452.5 |
| 2,802,517 | A | * | 8/1957 | Petersen | A47C 27/07 267/93 |

(Continued)

FOREIGN PATENT DOCUMENTS

GB 679490 A * 9/1952 ..... A47C 7/35

*Primary Examiner* — Adriana Figueroa

(74) *Attorney, Agent, or Firm* — Harness, Dickey & Pierce, P.L.C.

(57) ABSTRACT

A seat support assembly supports a cushion of a furniture member. The seat support assembly may include a frame, at least two seat springs, a support spring, and a coil spring. The support spring may be positioned between two seat springs, and the seat springs and the support spring may extend across the frame. A coil spring may be positioned on and attached to the support spring. The coil spring may extend to and bias against the two seat springs positioned on either side of the support spring.

19 Claims, 4 Drawing Sheets

(56) References Cited

U.S. PATENT DOCUMENTS

| | | | | | |
|---|---|---|---|---|---|
| 2,936,027 | A * | 5/1960 | Simon | A47C 7/342 | 267/91 |
| 3,111,690 | A * | 11/1963 | Tarlow | A47C 27/053 | 297/452.49 |
| 3,270,354 | A * | 9/1966 | Ciampa | A47C 7/347 | 5/260 |
| 3,338,571 | A * | 8/1967 | Koch | A47C 7/347 | 267/99 |
| 3,489,404 | A * | 1/1970 | Poovey | A47C 7/347 | 267/101 |
| 4,303,232 | A * | 12/1981 | Crosby | A47C 7/35 | 267/100 |
| 4,886,250 | A * | 12/1989 | Lucas | A47C 7/35 | 267/100 |
| 6,170,915 | B1 * | 1/2001 | Weisz | A47C 7/35 | 267/87 |
| 9,332,854 | B2 * | 5/2016 | Slusher, II | A47C 23/30 | |

* cited by examiner

SEAT SUPPORT ASSEMBLY FOR FURNITURE HAVING LEG REST EXTENSION AND SEAT BACK RECLINE

FIELD

The present disclosure relates to a seat support mechanism for furniture having a mechanism for moving a leg rest and reclining a seat back of the furniture

BACKGROUND

This section provides background information related to the present disclosure which is not necessarily prior art.

Furniture, such as chairs, sofas, loveseats, sectionals, and the like, can include a mechanism that allows an occupant of the furniture to move a leg rest panel and to recline a seat back of the furniture. As an example, the leg rest can be moved from a stowed or retracted position to a deployed or extended position to support the legs and/or feet of the occupant. Furthermore, the seat back can be rotatable to move the seat back from a fully upright position to a fully reclined position and/or a position between the fully upright position and the fully reclined position.

The furniture can include a cushion for supporting the occupant sitting or lying on the furniture. Due to a pressure exerted onto the cushion by the occupant, the cushion can protrude into a void between the cushion and the mechanism. In addition, as the seat back reclines and/or the leg rest extends, the cushion can move further into the void toward the mechanism. Accordingly, the cushion can interfere with the mechanism and, therefore, can affect the performance of the mechanism.

SUMMARY

This section provides a general summary of the disclosure, and is not a comprehensive disclosure of its full scope or all of its features.

The present disclosure is generally directed toward a seat support assembly for supporting a cushion of a furniture member. The seat support assembly may include a frame, at least two seat springs, a support spring, and a coil spring. With the support spring positioned between two seat springs, the seat springs and the support spring extend across the frame. A coil spring may be positioned on and attached to the support spring. The coil spring may extend to and bias against the two seat springs positioned on either side of the support spring.

The seat support assembly of the present disclosure may support the cushion without interfering with components positioned under the seat support assembly. For example, the cushion may rest upon the frame and is supported by the seat springs that extend across the frame. The coil spring may support and bias the seat springs toward the cushion, and the support spring may support and bias the coil spring toward the seat springs. Accordingly, the springs of the seat support assembly provide support to the cushion without the use of bulky fixtures that may interfere with other components positioned under the cushion.

Further areas of applicability will become apparent from the description provided herein. The description and specific examples in this summary are intended for purposes of illustration only, and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
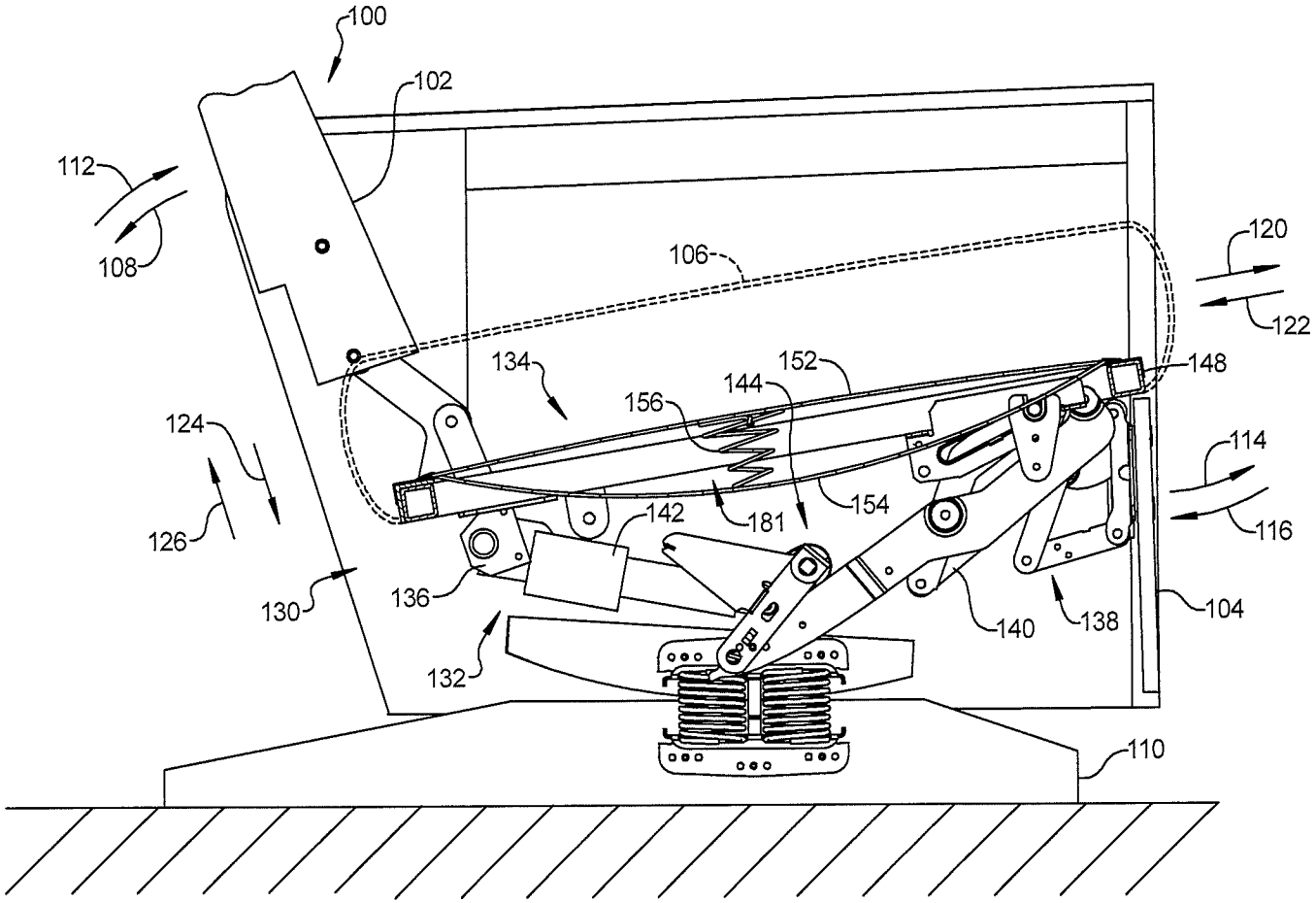
FIG. 1 is a partial side perspective view of a furniture including a seat support assembly of the present disclosure.

Example embodiments will now be described more fully with reference to the accompanying drawings.

Example embodiments are provided so that this disclosure will be thorough and will fully convey the scope to those who are skilled in the art. Numerous specific details are set forth, such as examples of specific components, devices, and methods, to provide a thorough understanding of the embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

The terminology used herein is for the purpose of describing particular example embodiments only, and is not intended to be limiting. As used herein, the singular forms "a," "an," and "the" may be intended to include the plural forms as well, unless the context clearly indicates otherwise. The terms "comprises," "comprising," "including," and "having," are inclusive and, therefore, specify the presence of stated features, elements, and/or components, but do not preclude the presence or addition of one or more other features, elements, components, and/or groups thereof.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a furniture member 100, such as a chair, includes a seat back member 102, a leg rest member 104, and a cushion 106. The seat back member 102 may rotate in a recline direction 108 with respect to a base member 110 from a fully upright position to a full reclined position or in an upright direction 112 to return to the fully upright position. The seat back member 102 may also be adjusted to any position between the fully upright position and the fully reclined position. The leg rest member is moveable in an extension direction 114 to extend the leg rest member 104 to an extended position away from the base member 110 and in a retraction direction 116 to return the leg rest member 104 to a stowed position toward the base member 110.

The cushion 106 supports an occupant sitting in the furniture member 100. The cushion 106 may also move based on the movement of the seat back member 102 and/or the leg rest member 104. For example, when the seat back member 102 rotates in the recline direction 108, the cushion 106 may extend away from the seat back member 102, as represented by arrow 120. Conversely, when the seat back member 102 rotates in the upright direction 112, the cushion 106 may move toward the seat back member 102, as represented by arrow 122. Furthermore, when the leg rest member 104 extends, one or more portions of the cushion 106 may move down toward the base member 110, as represented by arrow 124. When the leg rest member 104 retracts, one or more portions of the cushion 106 may move up away from the base member 110, as represented by arrow 126.

The furniture member 10 further includes a frame assembly 130 that includes a movement mechanism 132 and a seat support assembly 134. The movement mechanism 132 is attached to the base member 110 and provides one or more mechanisms for rotating the seat back member 102 and moving the leg rest member 104. For example, the movement mechanism 132 may include a rotational linkage 136 and a leg rest mechanism 138.

The rotational linkage 136 rotates the seat back member 102 in the recline direction 108 and the upright direction 112. The rotational linkage 136 may be moved by a force applied by an occupant against the seat back member 102 and/or by an actuator (not shown), such as an electric servo motor disposed under the seat support assembly 134 and controlled by a button operable by the occupant.

The leg rest mechanism 138 may include a pair of pantograph linkages 140 (only one shown). In the example embodiment, the pantograph linkages 140 are moveable by an electric motor 142 that is operable by the occupant via a control interface (not shown), such as a button. Alternatively, the pantograph linkages may be manually operated by the occupant by way of a handle.

The seat support assembly 134 supports the cushion 106 and prevents the cushion 106 from interfering with the movement mechanism 132. More particularly, the cushion 106 and the movement mechanism 132 are separated by a void 144. The seat support assembly 134 is positioned under the cushion 106 to prevent the cushion 106 from extending into the void 144 and possibly interfering with the movement mechanism 132.

Figure 2:
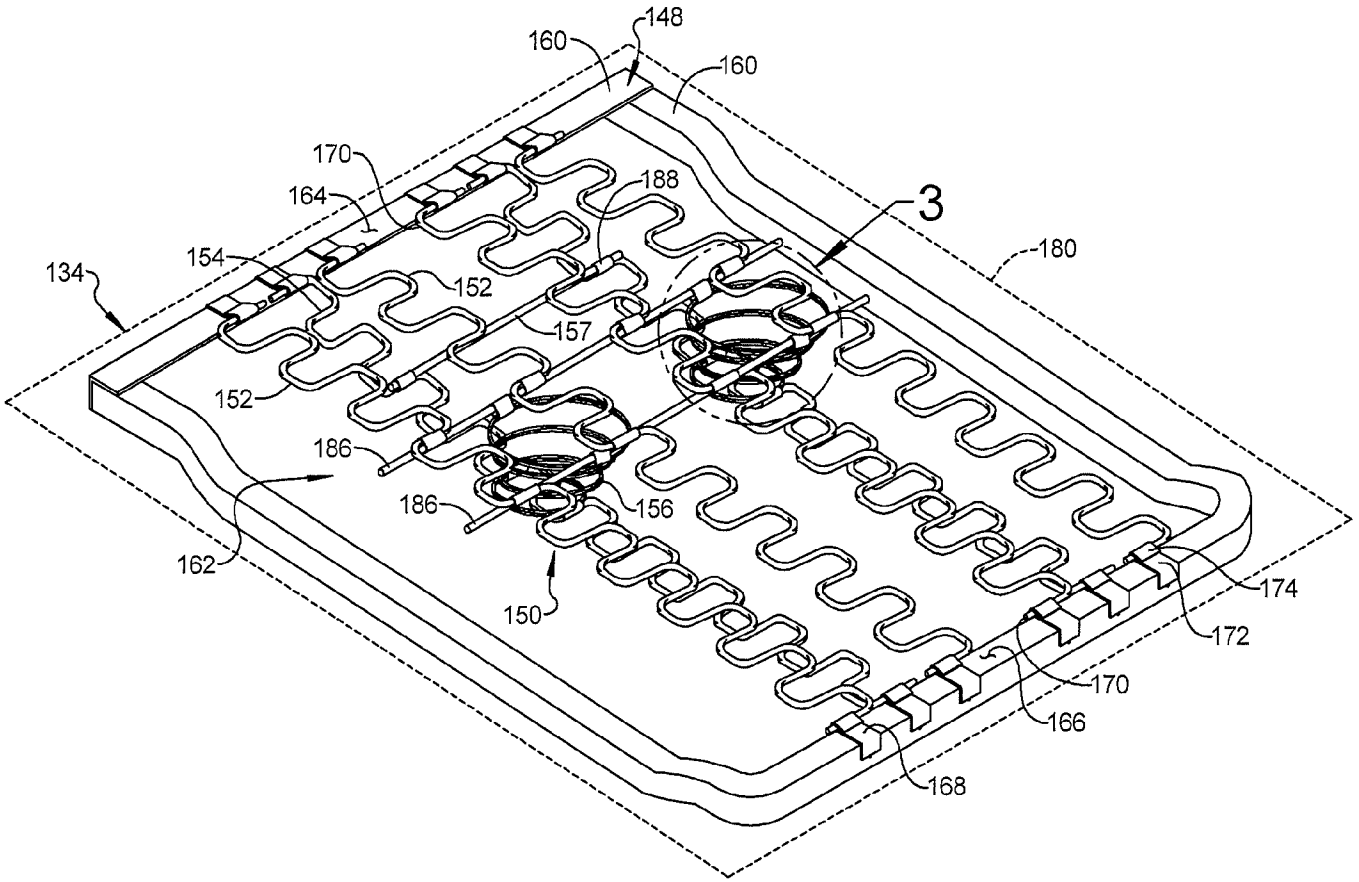
FIG. 2 is a perspective view of a seat support assembly in a first embodiment.
Figure 3:
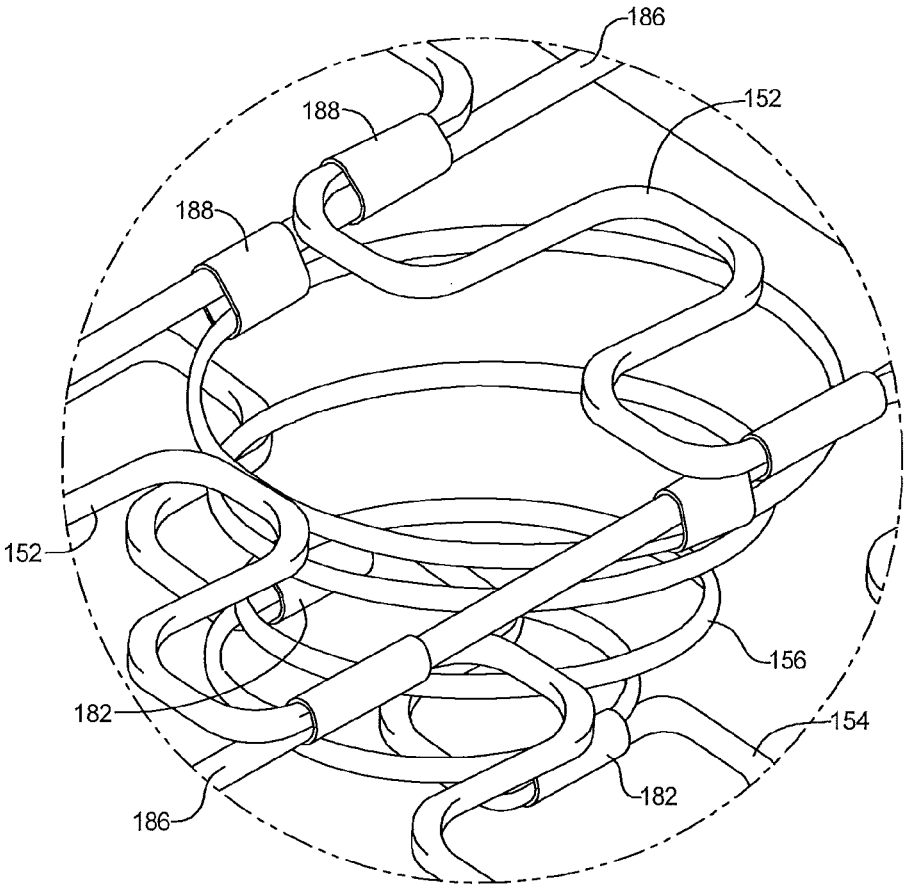
FIG. 3 is an enlarged perspective view of enclosure A of FIG. 2.
Figure 4:
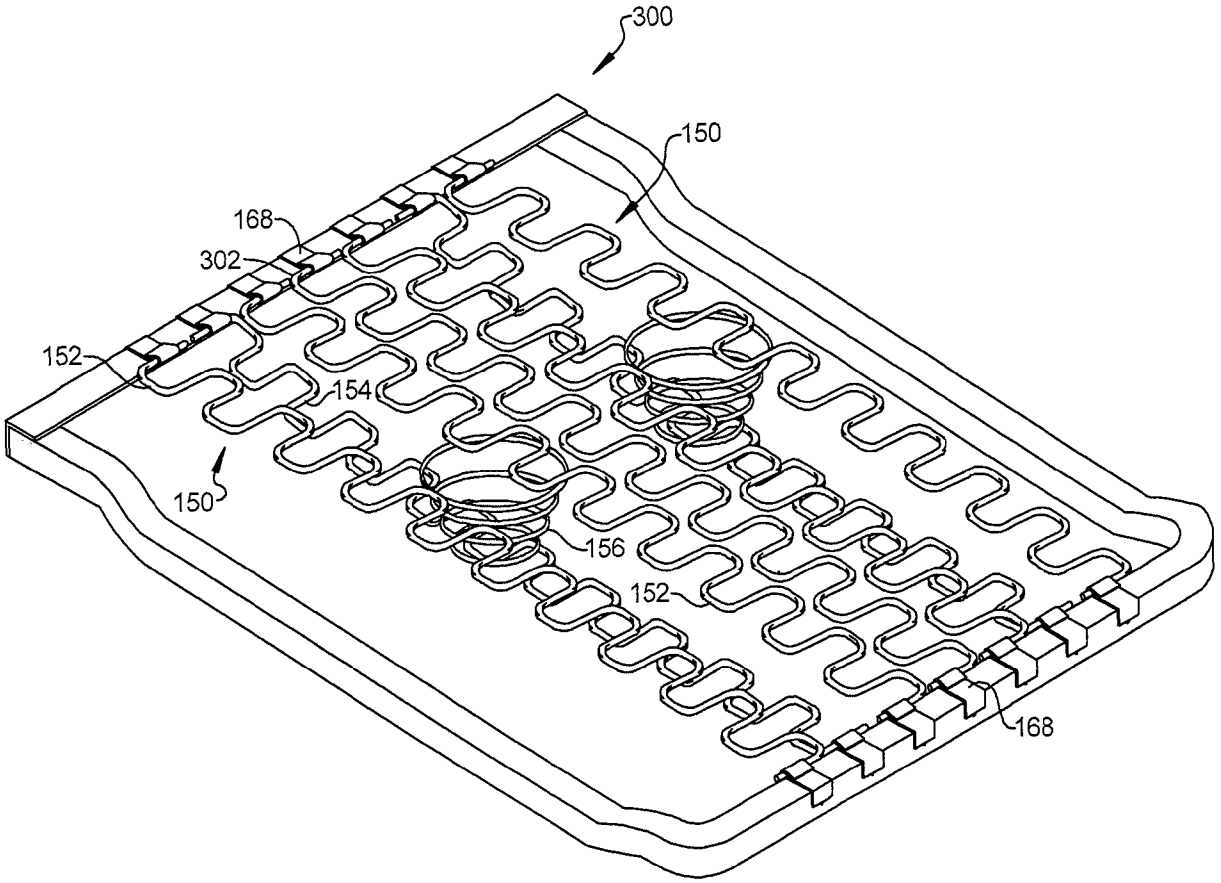
FIG. 4 is a perspective view of a seat support assembly in a second embodiment.

With additional reference to FIGS. 2 and 3, the seat support assembly 134 includes a frame 148 and at least one spring support subassembly 150 having two seat springs 152, a support spring 154, and a coil spring 156. The frame 148 is attached to the movement mechanism 132. The frame 148 supports the cushion 106 and may be separate from or integral with the cushion 106. The frame 148 may have one or more support members 160 that are fixedly attached to each other to form a rectangular shape and define an enclosed opening 162. The cushion 106 may rest on or is attached to the support members 160. In addition, a portion of the cushion 106 is positioned over the opening 162. While the frame 148 is illustrated as having a rectangular like shape, the frame 148 may be configured to have other suitable shapes for supporting the cushion 106, such as a square or circular shape, and is not limited to the shape illustrated. The support members 160 may be fixedly attached by way of, for example, an adhesive, welding, fasteners (i.e., bolts, screws, washers), and/or other suitable attachment mechanism. Alternatively, the frame 148 may be formed out of one support member.

The spring support subassembly 150 includes the two seat springs 152 and the support spring 154 positioned between the two seat springs 152. The coil spring 156 is positioned on top of and is attached to the support spring 154. The coil spring 156 extends between the support spring 154 and the two seat springs 152 to contact and bias against the seat springs 152. In the example embodiment, at least two spring support subassemblies 150 are provided for supporting the cushion 106. It is readily understood that any number of seat spring sub-assemblies may be used, and is not limited to the number illustrated.

The seat springs 152 and the support spring 154 are flat sinuous springs that span across the frame 148. The seat springs 152 and the support spring 154 may be collectively referred to as sinuous springs 152 and 154. The sinuous springs 152 and 154 extend from a first side 164 of the frame 148 to a second side 166 of the frame 148 that is opposite to the first side 164. The sinuous springs 152 and 154 may be made of wire, and more specifically metal wire that has a circular cross-section. Due to their construction and composition, the sinuous springs 152 and 154 are elastic and resilient, such that they may stretch and/or be deflected when acted on by a force and then spring back to their initial length and/or position when the force is removed. This may occur, for example, when a person sits or lies on the cushion 106.

Each of the sinuous springs 152 and 154 is attached to the frame 148 by way of spring clips 168 that are disposed at each end 170 of the sinuous springs 152 and 154. The spring clips 168 anchor each end 170 of the sinuous springs 152 and 154 to the frame 148. The spring clip 168 may include a clip base 172 that is flat and rectangular and a channel 174 that protrudes upwardly from the clip base 172. The channel 174 receives a portion of the sinuous springs 152 and 154 and clamps that portion against the frame 148. The clip base 172 is fixedly connected to the frame 148. For example, the clip base 172 may include a hole for receiving a fastener. The clip base 172 may be connected using other suitable methods, such as welding or adhesives, and is not limited to mechanical fasteners.

The seat springs 152 extend in parallel across the frame 148 and may define a support plane 180 with the frame 148. The cushion 106 may rest on top of the seat springs 152 along the support plane 180 and be supported by the seat springs 152. The support plane 180 may have a variety of different orientations, and the support plane 180 itself may be flat, bent, curved, or contoured based on the elastic property and structure of the seat springs 152. The cushion 106 is generally supported along the support plane 180 formed by the seat springs 152 regardless of orientation.

The support spring 154 extends across the frame 148 in an arc-like shape. Specifically, the support spring 154 extends from the first side 164 of the frame 148 toward the base member 110 (i.e., opposite direction of the support plane 180) and then extends upward toward the support plane 180 to attach to the second side 166 of the frame 148. As illustrated in FIG. 1, the support spring 154 defines a gap area 181 with the seat springs 152. Furthermore, the support spring 154 extends into the void 144 and is positioned relative to the movement mechanism 132 so that a predetermined clearance is maintained between the seat support assembly 134 and the movement mechanism 132.

The coil spring 156 may be a helical spring that extends between the support spring 154 and the two seat springs 152 within the gap area 181. More particularly, the coil spring 156 extends vertically from the support spring 154 to the seat springs 152 in an outwardly direction opening helix to contact both of the seat springs 152. The coil spring 156 biases the seat springs 152 toward the support plane 180. The coil spring 156 is attached to the support spring 154 by way of one or more clamps 182. While a variety of materials may be used, the coil spring 156 may be made of wire, and more specifically metal wire that has a circular cross-section. Due to its construction and composition, the coil spring 156 is elastic and resilient, such that it may compress and/or be deflected when acted on by a force and then spring back to its initial length and/or position when the force is removed. This may occur for example when the occupant sits or lies on the cushion 106.

The seat support assembly 134 may also include one or more upper transverse wires 186 and one or more lower transverse wires 187, which are collectively referred to as transverse wires 186 and 187. The upper transverse wires 186 span the frame 148 in a direction that is across (i.e., transverse to) the seat springs 152. The upper transverse wires 186 may be disposed just below the seat springs 152 on opposite sides of the coil spring 156. Each upper transverse wire 186 is attached to the seat springs 152 and the coil spring 156 by way of clamps 188. The lower transverse wire 187 spans the frame 148 in a direction that crosses the support spring 154. The lower transverse wire 187 is attached to each of the support springs 154 by way of the clamps 188.

The transverse wires 186 and 187 provide additional support for the seat springs 152, the coil spring 156, and the support springs 154. Specifically, the upper transverse wires 186 spread out the load of the force that is applied to adjacent seat springs 152 and/or coil spring 156 and prevent the seat springs 152 from being pushed out of alignment. Similarly, the lower transverse wire 187 prevents the support springs 154 from being pushed out of alignment due to pressure exerted onto the support springs 154 by respective coils springs 156. When a plurality of spring support subassemblies 150 are provided in the seat support assembly 134, the upper transverse wires 186 may be connected to each seat spring 152 and each coil spring 156, and the lower transverse wires 187 may be connected to each support spring 154. The location of the transverse wires 186 and 187 can be changed and is not limited to the location illustrated in the figures. For example, the lower transverse wires 187 may be positioned closer to an area where the support spring 154 is attached to the coil spring 156.

The seat support assembly 134 supports the cushion 106 and prevents the cushion 106 from interfering with the movement mechanism 132 located between the seat support assembly 134 and the base member 110. More particularly, the seat springs 152 support the cushion 106 along the support plane 180, the coil spring 156 supports and biases the seat springs toward the support plane 180, and the support spring 154 supports and biases the coil spring 156 toward the seat springs 152. When a force is exerted on to the cushion 106 by the occupant, the seat springs 152 maintain the position of the cushion 106 about the support plane 180 to prevent the cushion 106 from caving into the void 144 and interfering with the movement mechanism 132. The coil spring 156 maintains the position and/or minimizes the elastic deformation of the seat springs 152, so that the seat springs 152 do not interfere with the movement mechanism 132 even when the movement mechanism 132 reclines the seat back member 102 and/or extends the leg rest member 104. The support spring 154 maintains the position and/or minimizes the movement of the coil spring 156 within the void 144 to maintain a predetermined clearance from the movement mechanism 132. Accordingly, the seat support assembly 134 provides the necessary support to the cushion 106 while maintaining a predetermined distance from the movement mechanism 132.

By supporting the cushion 106, the seat support assembly 134 further improves the sitting comfort for an occupant. Specifically, the seat support assembly 134 may provide a firmer and more supportive cushion 106 that does not sag under the weight of the occupant.

Furthermore, by having the support spring 154, the seat support assembly 134 has a compact design for preventing interference with the movement mechanism 132. Specifically, the coil spring 156 is supported by a wire (i.e., support spring 154) that accommodates significantly less space than, for example, a rigid box like fixture that can be disposed under the coil spring 156.

In the example embodiment the seat support assembly 134 includes two spring support subassemblies 150. The seat support assembly 134 may further include additional seat springs 152 that are not supported by a coil spring 156. As an example, FIG. 3 illustrates a seat support assembly 300 that includes at least one seat spring 302 positioned between two spring support subassemblies 150. The seat spring 302 extends across the frame 148 and is attached to the frame 148 by way of clips 168 as seat springs 152 of the spring support subassemblies. The additional seat spring 302 provides additional support in an area between the spring support subassemblies 150. More particularly, the two, spring support subassemblies 150 are separated by a predetermined distance that prevents the coil springs 156 from interfering with each other. The seat spring 302 is positioned within the predetermined distance to provide additional support to the cushion 106. While FIG. 3 illustrates only one seat spring 302 between the two spring support subassemblies 150, more than one seat spring 302 may be used based on the space between the two spring support subassemblies.

The foregoing description of the embodiments has been provided for purposes of illustration and description. It is not intended to be exhaustive or to limit the disclosure. Individual elements or features of a particular embodiment are generally not limited to that particular embodiment but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A seat spring assembly for supporting a cushion of a furniture, the seat spring assembly comprising:

a frame defining an opening; and at least one spring support subassembly coupled to the frame and extending across the opening, wherein the at least one spring support subassembly includes three sinuous springs and a coil spring, the three sinuous springs extend in parallel across the opening and are coupled to the frame, the coil spring is positioned on one of the three sinuous springs and extends to and biases against the other two sinuous springs of the three sinuous springs, and the one of the three sinuous springs extends in an arc-like shape across the opening.

2. The seat spring assembly of claim 1 wherein the at least one spring support subassembly includes two spring support subassemblies.

3. The seat spring assembly of claim 2 further comprising:

a sinuous seat spring positioned between the two support subassemblies.

4. The seat spring assembly of claim 1 further comprising:

a plurality of clips attaching the three sinuous springs to the frame.

5. The seat spring assembly of claim 1 wherein the coil spring is attached to the one of the three sinuous springs.

6. The seat spring assembly of claim 1 further comprising:

at least one wire transversely extending across the other two sinuous springs of the three sinuous springs, wherein the other two sinuous springs of the three sinuous springs and the coil spring are attached to the at least one wire.

7. The seat spring assembly of claim 1 wherein the other two sinuous springs of the three sinuous springs define a support plane upon which the cushion is supported.

8. The seat spring assembly of claim 1 further comprising:

a sinuous seat spring positioned adjacent to the at least one spring support subassembly, wherein the sinuous seat spring extends across the frame and the opening parallel with the other two sinuous springs.

9. The seat spring assembly of claim 1 wherein the coil spring is a helical spring.

10. A seat spring assembly for supporting a cushion of a furniture, the seat spring assembly comprising:

a frame defining an opening;

at least two seat springs extending across the frame and the opening;

a support spring positioned between and parallel with the at least two seat springs and extending across the frame and the opening, wherein the support spring and the at least two seat springs are sinuous springs, and the support spring extends in an arc-like shape across the opening; and a coil spring positioned on and attached to the support spring, wherein the coil spring extends to and biases against the two of the at least two seat springs.

11. The seat spring assembly of claim 10 wherein:

the at least two seat springs include a first seat spring, a second seat spring, and a third seat spring, the first seat spring and the second seat spring are the two of the at least two sinuous springs positioned on either side of the support spring, and the third seat spring is positioned next to one of the first seat spring and the second seat spring such that the one of the first seat spring and the second seat spring is positioned between the third seat spring and the support spring.

12. The seat spring assembly of claim 10 wherein:

the support spring extending in the arc-like shape across the frame defines a gap between the support spring and the at least two seat springs, and the coil spring is positioned within the gap defined between the support spring and the at least two sinuous springs.

13. The seat spring assembly of claim 10 further comprising:

a plurality of clips coupling the at least two seat springs and the support spring to the frame.

14. The seat spring assembly of claim 10 further comprising:

at least one wire transversely extending across the at least two seat springs, wherein the at least two seat springs and the coil spring are attached to the at least one wire.

15. The seat spring assembly of claim 10 wherein the at least two seat springs define a support plane upon which the cushion is supported.

16. The seat spring assembly of claim 10 further comprising:

at least one wire transversely extending across the support spring, wherein the at least one wire is attached to the support spring.

17. A seat spring assembly for supporting a cushion of a furniture, the seat spring assembly comprising:

a frame having a first side and a second side;

at least two seat springs extending parallel across the frame from the first side to the second side;

a support spring positioned between the at least two seat springs and extending across the frame from the first side to the second side in parallel with the at least two seat springs, wherein the support spring and the at least two seat springs are sinuous springs and are coupled to the frame along the first side and the second side of the frame, and the support spring extends in an arc-like shape between the first side and the second side; and a coil spring positioned on and coupled to the support spring, wherein the coil spring extends to and biases against the at least two sinuous springs.

18. The seat spring assembly of claim 17 wherein:

the support spring extending in the arc-like shape between the first side and the second side of the frame defines a gap between the support spring and the at least two seat springs, and the coil spring is positioned within the gap defined between the support spring and the at least two sinuous springs.

19. The seat spring assembly of claim 17 further comprising:

at least one upper wire transversely extending across the at least two seat springs, wherein the at least two seat springs and the coil spring are attached to the at least one upper wire; and at least one lower wire transversely extending across the support spring, wherein the at least one lower wire is attached to the support spring.

* * * * *